US008863721B2

(12) United States Patent
Griffiths et al.

(10) Patent No.: US 8,863,721 B2
(45) Date of Patent: Oct. 21, 2014

(54) SEAL ALIGNMENT SYSTEMS

(71) Applicant: GM Global Technology Operations LLC, Detroit, MI (US)

(72) Inventors: Leonard Barry Griffiths, Fenton, MI (US); David R. Staley, Flushing, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 65 days.

(21) Appl. No.: 13/689,854

(22) Filed: Nov. 30, 2012

(65) Prior Publication Data

US 2014/0150748 A1 Jun. 5, 2014

(51) Int. Cl.
*F02B 77/00* (2006.01)

(52) U.S. Cl.
CPC ..... *F02B 77/00* (2013.01)
USPC ..... 123/195 C; 123/197.4; 277/591; 384/94; 384/95

(58) Field of Classification Search
CPC ..... F16J 15/00; F16J 15/02; F16J 15/16; F01C 19/00; F02F 11/00
USPC ..... 123/197.1, 197.4, 195 C, 198 E; 277/590, 591, 313; 384/94, 95
See application file for complete search history.

(56) References Cited

U.S. PATENT DOCUMENTS

| | | | | |
|---|---|---|---|---|
| 3,128,105 | A * | 4/1964 | Liebig | 277/577 |
| 3,415,137 | A * | 12/1968 | Casale | 74/395 |
| 3,589,737 | A | 6/1971 | Sedy | |
| 3,845,622 | A * | 11/1974 | Hufstader | 60/330 |
| 4,883,031 | A * | 11/1989 | Ampferer et al. | 123/195 C |
| 7,597,082 | B2 * | 10/2009 | Stemmer | 123/195 C |
| 7,959,159 | B2 * | 6/2011 | Hocker et al. | 277/559 |
| 8,161,933 | B2 * | 4/2012 | Gast et al. | 123/179.25 |
| 2007/0163530 | A1 * | 7/2007 | Luchs | 123/90.37 |
| 2011/0278803 | A1 * | 11/2011 | Yamazaki et al. | 277/654 |

* cited by examiner

*Primary Examiner* — Noah Kamen
*Assistant Examiner* — Grant Moubry
(74) *Attorney, Agent, or Firm* — Quinn Law Group, PLLC

(57) ABSTRACT

A seal alignment system includes an engine block, a cover component spaced apart from the engine block and defining a first bore therethrough, and a crankshaft protruding from the engine block and extending through the first bore, wherein the crankshaft is rotatable about a central longitudinal axis and has an outer surface. The seal alignment system also includes an annular seal spaced apart from the engine block and defining a second bore therethrough, and an alignment device configured for coaxially aligning the annular seal with the central longitudinal axis so that the crankshaft extends through the second bore and the annular seal abuts the outer surface.

14 Claims, 2 Drawing Sheets

SEAL ALIGNMENT SYSTEMS

TECHNICAL FIELD

The disclosure relates to a seal alignment system.

BACKGROUND

A crankshaft of an engine may convert a linear motion from reciprocating pistons into rotational motion. More specifically, during engine operation, the crankshaft may protrude from a cylinder block of the engine, extend through a timing cover spaced apart from the cylinder block, and rotate about a central longitudinal axis in response to the linear motion of the reciprocating pistons.

The timing cover generally covers and protects any timing gears, belts, and/or chains of the engine. Often, a crankshaft seal may seal an interface between the crankshaft and the timing cover. That is, the crankshaft seal may abut the crankshaft to prevent lubricant loss from the engine and/or contamination of the gears, belts, and chains.

SUMMARY

A seal alignment system includes an engine block, a cover component spaced apart from the engine block and defining a first bore therethrough, and a crankshaft protruding from the engine block and extending through the first bore. The crankshaft is rotatable about a central longitudinal axis and has an outer surface. The seal alignment system further includes an annular seal spaced apart from the engine block and defining a second bore therethrough, and an alignment device configured for coaxially aligning the annular seal with the central longitudinal axis so that the crankshaft extends through the second bore, and the annular seal abuts the outer surface.

In one embodiment, the engine block includes an annular bearing defining a third bore therethrough. The crankshaft extends through the third bore, and the annular bearing is spaced apart from the annular seal along the central longitudinal axis. Further, the cover component is spaced apart from the engine block by the alignment device. The alignment device includes a plurality of pins attached to and extending from the engine block so that each of the plurality of pins is substantially parallel to and spaced apart from the central longitudinal axis. In addition, the cover component further defines a plurality of holes therein each configured for receiving a respective one of the plurality of pins, wherein each of the plurality of pins is disposed within a respective one of the plurality of holes so that the annular seal is coaxial with the central longitudinal axis.

In another embodiment, the cover component defines an annular channel therein, and the annular channel is spaced apart from the engine block by the alignment device. The alignment device includes a tube defining an interior cavity. The tube has an interior surface, a first portion having a first end, and a second portion matable with the first portion and having a second end spaced apart from the first end. Further, the annular seal is disposed within the interior cavity and abuts the interior surface. In addition, the second portion is fixedly attached to the engine block so that the second portion is not rotatable about the central longitudinal axis. The first end is disposed within the annular channel so that the second end is spaced apart from the cover component and the annular seal is coaxial with the central longitudinal axis.

The detailed description and the drawings or Figures are supportive and descriptive of the disclosure, but the scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Figure 1:
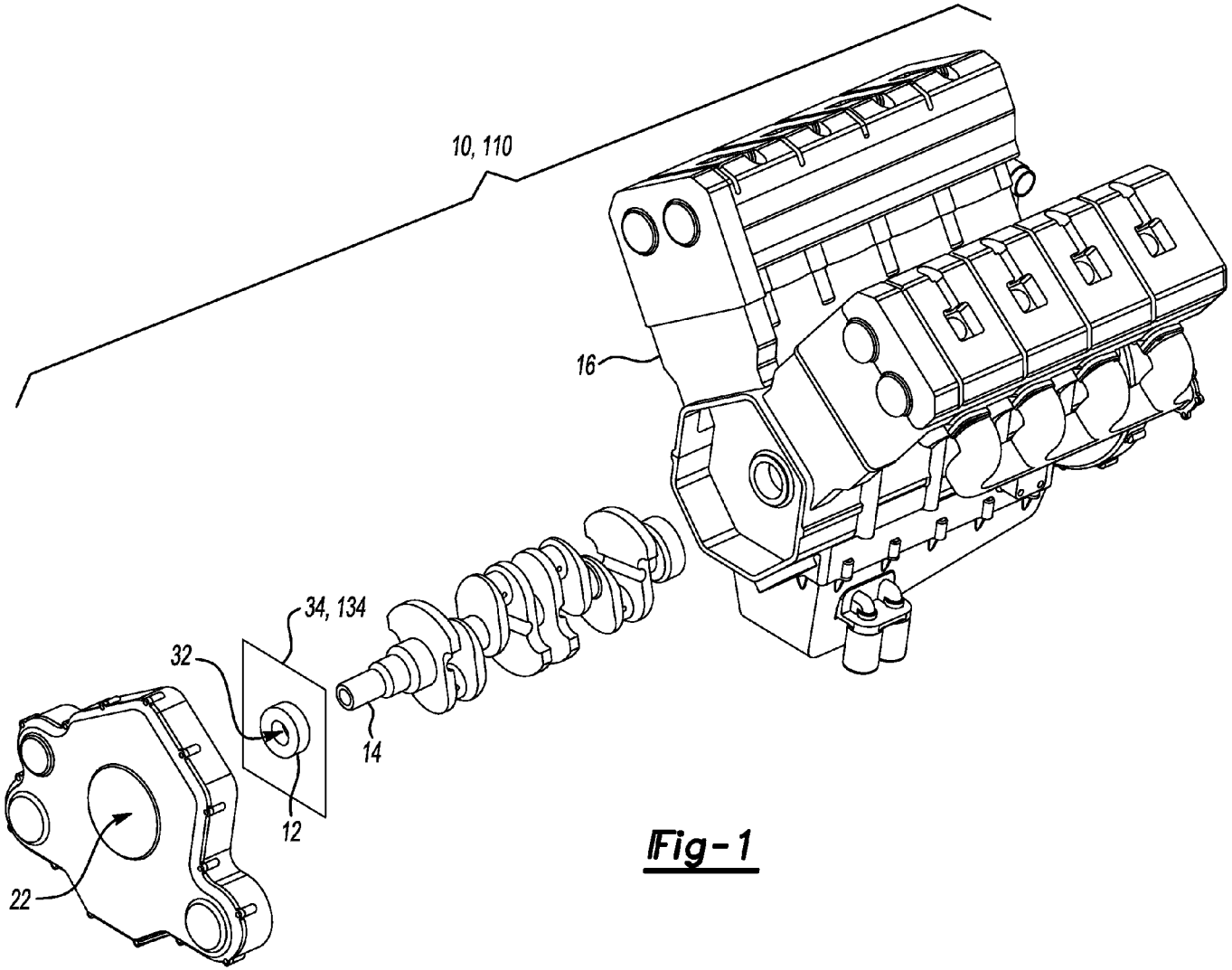
FIG. 1 is a schematic perspective exploded illustration of a seal alignment system including an engine block and an alignment device.

Referring to the Figures, wherein like reference numerals refer to like elements, a seal alignment system 10, 110 is shown generally in FIG. 1. The seal alignment system 10, 110 may be useful for vehicles, such as automotive vehicles, that may require precise alignment between an annular seal 12 and a crankshaft 14 of an internal combustion engine 16. However, the seal alignment system 10, 110 may also be useful for non-automotive applications including, for example, aviation applications.

Figure 2:
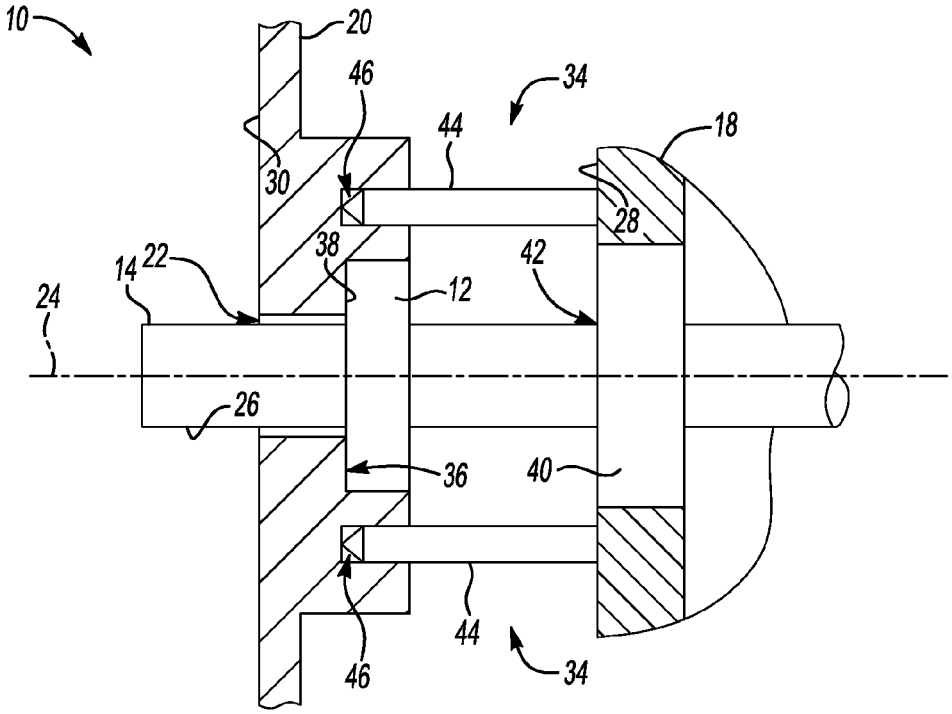
FIG. 2 is a schematic illustration of a cross-sectional view of one embodiment of the alignment device of FIG. 1.
Figure 3:
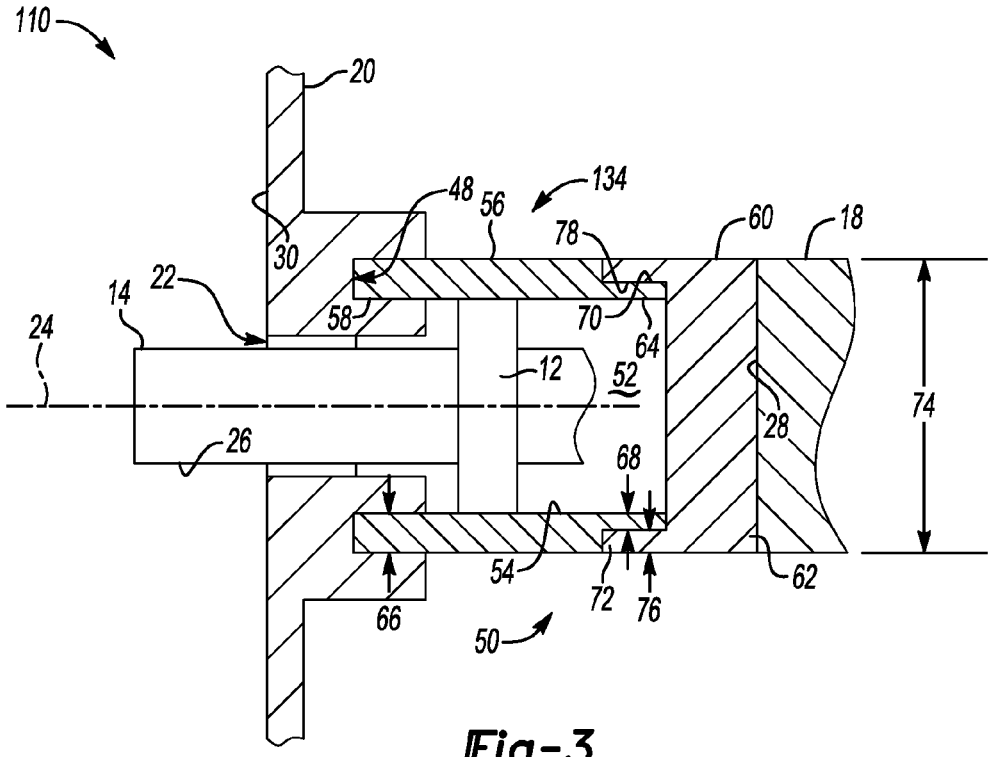
FIG. 3 is a schematic illustration of a cross-sectional view of another embodiment of the alignment device of FIG. 1.

Referring now to FIGS. 2 and 3, the seal alignment system 10 includes an engine block 18 and a cover component 20 spaced apart from the engine block 18. The engine block 18 may be a cylinder block of the internal combustion engine 16 (FIG. 1), and may be formed from a first material having a first coefficient of linear thermal expansion. For example, the engine block 18 may be formed from a metal, such as, but not limited to, cast iron or an aluminum alloy, and the first coefficient of linear thermal expansion may be from about $8\times10^{-6}$ m/m K to about $25\times10^{-6}$ m/m K.

Further, with continued reference to FIGS. 2 and 3, the cover component 20 may be a timing cover and may be configured to protect gears (not shown), timing chains (not shown) and/or belts (not shown), and the like of the internal combustion engine 16 (FIG. 1). More specifically, the cover component 20 may be configured to sealingly attach to the engine block 18 so that the gears and timing chains and/or belts may be lubricated by engine oil. Although shown as generally attached to a front portion of the internal combustion engine 16 in FIG. 1, e.g., at a crank pulley, the cover component 20 may alternatively be spaced apart from the engine block 18 and attach to a rear portion of the internal combustion engine 16, e.g., at a flywheel. Further, as best shown in FIG. 1, the cover component 20 defines a first bore 22 therethrough. The first bore 22 may have a generally circular shape and may be configured for receiving the crankshaft 14 of the seal alignment system 10, as set forth in more detail below.

The cover component 20 may be formed from a second material that is different from the first material. As such, the second material has a second coefficient of linear thermal expansion that is different from the first coefficient of linear thermal expansion. For example, the cover component 20 may be formed from a plastic or composite, such as, but not limited to, acrylonitrile butadiene styrene and glass-reinforced polyamide. The second coefficient of linear thermal expansion may be from about $10\times10^{-6}$ m/m K to about $150\times10^{-6}$ m/m K, e.g., from about $65\times10^{-6}$ m/m K to about $90\times10^{-6}$ m/m K. That is, the second coefficient of linear thermal expansion of the cover component 20 may be larger than the first coefficient of linear thermal expansion of the engine block 18. Further, it is to be appreciated that glass reinforcement may affect the second coefficient of linear thermal expansion. As such, the engine block 18 and cover component 20 may expand at different rates when heated and cooled.

Referring again to FIGS. 2 and 3, the seal alignment system 10, 110 also includes the crankshaft 14 protruding from the engine block 18 and extending through the first bore 22, wherein the crankshaft 14 is rotatable about a central longitudinal axis 24 and has an outer surface 26. That is, the crankshaft 14 may be configured to convert linear motion of a plurality of reciprocating pistons (not shown) disposed within the engine block 18 into rotational motion along the central longitudinal axis 24. Therefore, the central longitudinal axis 24 may be substantially perpendicular to a front or rear face 28 of the engine block 18, and to an exterior surface 30 of the cover component 20.

With continued reference to FIGS. 2 and 3, the seal alignment system 10, 110 further includes the annular seal 12 spaced apart from the engine block 18 and defining a second bore 32 (FIG. 1) therethrough. That is, the annular seal 12 may be ring-shaped and may be at least partially formed of an elastomer. The annular seal 12 may be referred to as a crankshaft seal, and the second bore 32 may be configured for receiving the crankshaft 14, as also set forth in more detail below. As such, the second bore 32 may also have a generally circular shape.

As shown in the Figures, the seal alignment system 10, 110 also includes an alignment device 34, 134 configured for coaxially aligning the annular seal 12 with the central longitudinal axis 24 so that the crankshaft 14 extends through the second bore 32 (FIG. 1), and the annular seal 12 abuts the outer surface 26. That is, the alignment device 34, 134 may minimize misalignment of the annular seal 12 with respect to the central longitudinal axis 24 of the crankshaft 14. More specifically, the alignment device 34, 134 may constrain the cover component 20 so that the cover component 20 does not expand with respect to the annular seal 12 and does not move along the central longitudinal axis 24 with respect to the engine block 18, as set forth in more detail below.

Referring now to FIG. 2, in one embodiment, the cover component 20 defines an annular recession 36 therein and has a seating surface 38. The annular recession 36 may face the engine block 18, as shown in FIG. 2, or may be spaced opposite the engine block 18 and recede from the exterior surface 30. The annular seal 12 may be disposed within the annular recession 36 in contact with the seating surface 38. That is, the annular seal 12 may surround the crankshaft 14 and seat against the seating surface 38 within the annular recession 36.

In addition, as shown in FIG. 2, the engine block 18 may include an annular bearing 40 defining a third bore 42 therethrough, wherein the crankshaft 14 extends through the third bore 42 and the annular bearing 40 is spaced apart from the annular seal 12 along the central longitudinal axis 24. The annular bearing 40 may be, for example, a front crankshaft bearing and may be disposed adjacent to and in contact with the engine block 18. Since the third bore 42 is configured for receiving the crankshaft 14, the third bore 42 may also have a generally circular shape.

Further, with continued reference to FIG. 2, for this embodiment, the alignment device 34 includes a plurality of pins 44 attached to and extending from the engine block 18. Each of the plurality of pins 44 may be substantially parallel to and spaced apart from the central longitudinal axis 24. For example, the plurality of pins 44 may be equally spaced apart from the central longitudinal axis 24 to form a radial arrangement about the crankshaft 14. The plurality of pins 44 may be, for example, pressed or screwed into the engine block 18.

In addition, as shown in FIG. 2, the cover component 20 may further define a plurality of holes 46 therein each configured for receiving a respective one of the plurality of pins 44. That is, each of the plurality of pins 44 may be disposed within a respective one of the plurality of holes 46 so that the annular seal 12 is coaxial with the central longitudinal axis 24. Each of the plurality of pins 44 may extend from the engine block 18 and protrude into the respective one of the plurality of holes 46 so that the cover component 20 is attached to the engine block 18 along the central longitudinal axis 24. Stated differently, as shown in FIG. 2, the cover component 20 may be spaced apart from the engine block 18 by the alignment device 34. As such, each of the plurality of pins 44 disposed within the respective one of the plurality of holes 46 may minimize misalignment of the annular seal 12 with respect to the crankshaft 14.

In particular, with continued reference to FIG. 2, during operation of the internal combustion engine 16 (FIG. 1), as an operating temperature of the internal combustion engine 16 increases, the cover component 20 may expand at a different rate than the engine block 18 due to a difference between the first coefficient of linear thermal expansion and the second coefficient of linear thermal expansion. Without the alignment device 34, e.g., each of the plurality of pins 44 disposed within a respective one of the plurality of holes 46, the annular seal 12 may tilt or misalign with respect to the crankshaft 14 while the cover component 20, annular recession 36, and/or seating surface 38 change shape. That is, the annular seal 12 may not be coaxially aligned with the central longitudinal axis 24 as the operating temperature of the internal combustion engine 16 (FIG. 1) rises. Advantageously, however, the alignment device 34 provides excellent coaxial alignment of the annular seal 12 with respect to the central longitudinal axis 24 and ensures that the annular seal 12 does not unseat from the seating surface 38. That is, the alignment device 34 co-locates the annular seal 12 and the crankshaft 14, even during temperature changes which may cause the cover component 20 and engine block 18 to linearly expand at different rates. Stated differently, each of the plurality of pins 44 disposed within the respective one of the plurality of holes 46 may constrain the cover component 20 so that the cover component 20 does not expand with respect to the annular seal 12 between adjacent ones of the plurality of pins 44, e.g., at the location of the annular seal 12. In addition, each of the plurality of holes 46 may be lined with an elastomeric sleeve to provide joint compliance and acoustic attenuation when the each of the plurality of pins 44 is disposed within the respective one of the plurality of holes 46.

Referring now to FIG. 3, in another embodiment, the cover component 20 may define an annular channel 48 therein. The annular channel 48 may be configured for receiving the alignment device 134 of the seal alignment system 110, as set forth in more detail below. Further, the annular channel 48 may be spaced apart from the first bore 22, and may not extend entirely through the cover component 20.

For this embodiment, as described with continued reference to FIG. 3, the alignment device 134 may include a tube 50 defining an interior cavity 52 and having an interior surface 54, a first portion 56 having a first end 58, and a second portion 60. The second portion 60 may be matable with the first portion 56 and may have a second end 62 spaced apart from the first end 58. Further, the second end 62 may be fixedly attached to the engine block 18 so that the second portion 60 is not rotatable about the central longitudinal axis 24 and is aligned with the central longitudinal axis 24. For example, although not shown, the second end 62 may be bolted or screwed to the engine block 18.

Referring again to FIG. 3, the annular seal 12 may be disposed within the interior cavity 52 and may abut the interior surface 54. In particular, the crankshaft 14 may extend through the second bore 32 (FIG. 1) of the annular seal 12 and may be disposed within the interior cavity 52 of the tube 50. Although the annular seal 12 may be disposed at any location along the central longitudinal axis 24 within the tube 50, generally, the annular seal 12 may be disposed comparatively closer to the cover component 20 than to the engine block 18.

In addition, as shown in FIG. 3, the first portion 56 of the tube 50 may have a third end 64 spaced apart from the first end 58, a first thickness 66 at the first end 58, and a third thickness 68 at the third end 64 that is less than the first thickness 66. That is, the first portion 56 may decrease in thickness at the third end 64 so as to form a first mating surface 70. Further, the second portion 60 of the tube 50 may have a fourth end 72 spaced apart from the second end 62, a second thickness 74 at the second end 62, and a fourth thickness 76 at the fourth end 72 that is less than the second thickness 74. That is, the second portion 60 may also decrease in thickness at the fourth end 72 so as to form a second mating surface 78.

With continued reference to FIG. 3, the third end 64 may be mated to the fourth end 72 so that the cover component 20 is constrained and does not expand with respect to the annular seal 12, and does not move along the central longitudinal axis 24 with respect to the engine block 18. Stated differently, the third end 64 may be mated to the fourth end 72 so that movement between the cover component 20 and annular seal 12 is minimized. That is, the first mating surface 70 may contact the second mating surface 78 so that the first portion 56 is mated to the second portion 60. More specifically, the first thickness 66 may be equal to a sum of the third thickness 68 and the fourth thickness 76. Therefore, the first portion 56 and the second portion 60 may form a stepped register arrangement and may mate so that the first mating surface 70 contacts the second mating surface 78.

As shown in FIG. 3, the first end 58 may be disposed within the annular channel 48 so that the second end 62 is spaced apart from the cover component 20 and the annular seal 12 is coaxial with the central longitudinal axis 24. For example, the first end 58 may be press-fit or molded into the cover component 20 at the annular channel 48 so that the first portion 56 is not rotatable about the central longitudinal axis 24. Likewise, as set forth above, since the second portion 60 may be fixedly attached to the engine block 18, the second portion 60 may not be rotatable about the central longitudinal axis 24. As such, when the first portion 56 is mated with the second portion 60, the tube 50 is not rotatable about the central longitudinal axis 24. Further, since the first portion 56 is constrained from translating towards or away from the engine block 18 when disposed within the annular channel 48, the annular seal 12 may remain coaxial with the central longitudinal axis 24, even upon exposure to changes in temperature which may cause the cover component 20 and the engine block 18 to linearly expand at different rates.

In particular, with continued reference to FIG. 3, during operation of the internal combustion engine 16 (FIG. 1), as an operating temperature of the internal combustion engine 16 increases, the cover component 20 may expand at a different rate than the engine block 18 due to a difference between the first coefficient of linear thermal expansion and the second coefficient of linear thermal expansion. Without the alignment device 134, e.g., the tube 50 disposed within the annular channel 48, the annular seal 12 may tilt or misalign with respect to the crankshaft 14 while the cover component 20 changes shape. That is, the annular seal 12 may not be coaxially aligned with the central longitudinal axis 24 as the operating temperature of the internal combustion engine 16 (FIG. 1) rises. Advantageously, however, the alignment device 134 provides excellent coaxial alignment of the annular seal 12 with respect to the central longitudinal axis 24 and ensures that the annular seal 12 does not unseat from the outer surface 26 of the crankshaft 14. That is, the alignment device 134 co-locates the annular seal 12 and the crankshaft 14, even during temperature changes which may cause the cover component 20 and engine block 18 to linearly expand at different rates. Stated differently, the tube 50 disposed within the annular channel 48 may constrain the cover component 20 so that the cover component 20 does not expand with respect to the annular seal 12 within the interior cavity 52, e.g., at the location of the annular seal 12.

Therefore, the aforementioned seal alignment system 10, 110 minimizes thermal expansion of the cover component 20 with respect to the annular seal 12 at a location of the annular seal 12. As such, the seal alignment system 10, 110 provides for and maintains alignment of the annular seal 12 with respect to the cover component 20 along the central longitudinal axis 24. Therefore, the cover component 20 and the engine block 18 may be formed from different materials, and may expand at differing rates in response to a thermal stimulus, but may not disrupt coaxial alignment of the annular seal 12 and the central longitudinal axis 24. As such, the annular seal 12 may sufficiently and effectively seal against the outer surface 26 of the crankshaft 14 during operation of the internal combustion engine 16.

While the best modes for carrying out the disclosure have been described in detail, those familiar with the art to which this disclosure relates will recognize various alternative designs and embodiments for practicing the disclosure within the scope of the appended claims.

The invention claimed is:

1. A seal alignment system comprising:

an engine block formed from a first material having a first coefficient of linear thermal expansion;

a cover component formed from a second material that is different from the first material and has a second coefficient of thermal expansion that is different from the first coefficient of linear thermal expansion, wherein the cover component is spaced apart from the engine block and defines an annular channel therein and a first bore therethrough;

a crankshaft protruding from the engine block and extending through the first bore, wherein the crankshaft is rotatable about a central longitudinal axis and has an outer surface;

an annular seal spaced apart from the engine block and defining a second bore therethrough; and an alignment device configured for coaxially aligning the annular seal with the central longitudinal axis so that the crankshaft extends through the second bore and the annular seal abuts the outer surface;

wherein the alignment device includes a tube defining an interior cavity and having:

an interior surface;

a first portion having a first end; and a second portion matable with the first portion and having a second end spaced apart from the first end, wherein the second portion is fixedly attached to the engine block so that the second portion is not rotatable about the central longitudinal axis.

2. The seal alignment system of claim 1, wherein the cover component is spaced apart from the engine block by the alignment device.

3. The seal alignment system of claim 1, wherein the annular seal is disposed within the interior cavity and abuts the interior surface.

4. The seal alignment system of claim 1, wherein the first end is disposed within the annular channel so that the annular seal is coaxial with the central longitudinal axis.

5. The seal alignment system of claim 4, wherein the first portion has:

a third end spaced apart from the first end;

a first thickness at the first end; and a third thickness at the third end that is less than the first thickness; and further wherein the second portion has:

a fourth end spaced apart from the second end;

a second thickness at the second end; and a fourth thickness at the fourth end that is less than the second thickness.

6. The seal alignment system of claim 5, wherein the third end is mated to the fourth end so that the cover component is constrained so that the cover component does not expand with respect to the annular seal and does not move along the central longitudinal axis with respect to the engine block.

7. The seal alignment system of claim 5, wherein the first thickness is equal to a sum of the third thickness and the fourth thickness.

8. A seal alignment system comprising:

an engine block;

a cover component spaced apart from the engine block and defining a first bore therethrough;

a crankshaft protruding from the engine block and extending through the first bore, wherein the crankshaft is rotatable about a central longitudinal axis and has an outer surface;

an annular seal spaced apart from the engine block and defining a second bore therethrough;

wherein the engine block includes an annular bearing defining a third bore therethrough, and further wherein the crankshaft extends through the third bore and the annular bearing is spaced apart from the annular seal along the central longitudinal axis; and an alignment device configured for coaxially aligning the annular seal with the central longitudinal axis so that the crankshaft extends through the second bore and the annular seal abuts the outer surface, wherein the cover component is spaced apart from the engine block by the alignment device;

wherein the alignment device includes a plurality of pins attached to and extending from the engine block so that each of the plurality of pins is substantially parallel to and spaced apart from the central longitudinal axis;

wherein the cover component further defines a plurality of holes therein each configured for receiving a respective one of the plurality of pins; and wherein each of the plurality of pins is disposed within a respective one of the plurality of holes so that the annular seal is coaxial with the central longitudinal axis.

9. The seal alignment system of claim 8, wherein each of the plurality of pins disposed within the respective one of the plurality of holes constrains the cover component so that the cover component does not expand with respect to the annular seal between adjacent ones of the plurality of pins.

10. The seal alignment system of claim 8, wherein the alignment device constrains the cover component so that the cover component does not expand with respect to the annular seal and does not move along the central longitudinal axis with respect to the engine block.

11. The seal alignment system of claim 8, wherein the cover component defines an annular recession therein and has a seating surface, and further wherein the annular seal is disposed within the annular recession in contact with the seating surface.

12. A seal alignment system comprising:

an engine block;

a cover component spaced apart from the engine block and defining a first bore therethrough and an annular channel therein;

a crankshaft protruding from the engine block and extending through the first bore, wherein the crankshaft is rotatable about a central longitudinal axis and has an outer surface;

an annular seal spaced apart from the engine block and defining a second bore therethrough; and an alignment device configured for coaxially aligning the annular seal with the central longitudinal axis so that the crankshaft extends through the second bore and the annular seal abuts the outer surface, wherein the cover component is spaced apart from the engine block by the alignment device;

wherein the alignment device includes a tube defining an interior cavity and having:

an interior surface;

a first portion having a first end; and a second portion matable with the first portion and having a second end spaced apart from the first end;

wherein the annular seal is disposed within the interior cavity and abuts the interior surface;

wherein the second portion is fixedly attached to the engine block so that the second portion is not rotatable about the central longitudinal axis; and wherein the first end is disposed within the annular channel so that the second end is spaced apart from the cover component and the annular seal is coaxial with the central longitudinal axis.

13. The seal alignment system of claim 12, wherein the tube disposed within the annular channel constrains the cover component so that the cover component does not expand with respect to the annular seal within the interior cavity.

14. The seal alignment system of claim 12, wherein the alignment device constrains the cover component so that the cover component does not expand with respect to the annular seal and does not move along the central longitudinal axis with respect to the engine block.

* * * * *